United States Patent [19]

Karas et al.

[11] Patent Number: 4,637,117

[45] Date of Patent: Jan. 20, 1987

[54] METHOD FOR DEEP DRAWING THIN METAL STOCK INTO CONTAINERS AND THEREAFTER COATING EACH CONTAINER

[75] Inventors: Richard J. Karas, Addison; John LaRosa, Carpentersville, both of Ill.

[73] Assignee: American Can Company, Greenwich, Conn.

[21] Appl. No.: 548,812

[22] Filed: Oct. 4, 1983

Related U.S. Application Data

[60] Division of Ser. No. 251,232, Apr. 6, 1981, abandoned, which is a continuation of Ser. No. 016,371, Mar. 1, 1979, abandoned.

[51] Int. Cl.[4] ..... B23P 17/00; B23P 25/00; B21B 45/02

[52] U.S. Cl. ..... 29/527.4; 29/428; 29/DIG. 11; 29/DIG. 25; 72/42; 72/347

[58] Field of Search ..... 29/557, 558, 527.1, 29/527.2, 527.4, 428, DIG. 11, DIG. 25; 72/42, 347, 346

[56] References Cited

U.S. PATENT DOCUMENTS

| | | | |
|---|---|---|---|
| 3,110,413 | 11/1963 | McKay et al. | 29/527.2 X |
| 4,032,678 | 6/1977 | Perfetti et al. | 72/46 |
| 4,450,977 | 5/1984 | Colburn et al. | 72/46 |
| 4,452,374 | 6/1984 | Hitchcock et al. | 72/46 |
| 4,507,339 | 3/1985 | Carbo et al. | 72/46 |

*Primary Examiner*—Howard N. Goldberg
*Assistant Examiner*—Ronald S. Wallace
*Attorney, Agent, or Firm*—Ernestine C. Bartlett; Paul R. Audet

[57] ABSTRACT

A lubricant is provided to help in drawing containers such as cans from tinplate or coated tin free steel and to assist the metal forming process during drawing. The lubricant is formulated to permit a post spray without removal of the lubricant thereby eliminating washing and drying the container before post spraying. Post spray coatings are solvent or water based and are necessary to protect the container from the harmful effects of the material carried within the container and in turn to prevent contamination of the product by its container. A method of lubricating a metal to be deeply drawn into a sanitary can is explained and includes leaving the lubricant on the can during interior post coating operations.

15 Claims, No Drawings

METHOD FOR DEEP DRAWING THIN METAL STOCK INTO CONTAINERS AND THEREAFTER COATING EACH CONTAINER

This is a division of application Ser. No. 251,232 filed Apr. 6, 1981, now abandoned, which was a continuation of application Ser. No. 016,371 filed Mar. 1, 1979, now abandoned.

BACKGROUND OF THE INVENTION

The process in forming deeply drawn containers requires a lubricated sheet stock for proper forming. Such lubricants include peanut oil, lanolin, petrolatum and castor oil, and many others. It is possible to deeply draw a container lubricated with any of the mentioned lubricants and others, see for example U.S. Pat. No. 4,042,515. Deep drawing permits forming a two-piece drawn can which is a preferred container in that the only seam is at the cover. The practice of heavily lubricating the sheet stock for a two-piece deeply drawn can is necessary because of the stresses introduced during forming. While certain chlorinated paraffins when used as draw lubricants may be post coated without removal they are not approved for such use in a food container by the Food and Drug Administration without complete removal prior to post coating. The lubricant of the present invention is approved when applied as set forth and post baked. No other acceptable technique is available to manufacture drawn and redrawn cans which will permit direct post coating operations on the completed cans (on either the inside or the outside surface). The most frequent method of coating application is by post spraying the cans using a typical can makers spray machine, where the cans are brought into position in front of a stationary spray nozzle, are sprayed, and are then carried away to a curing oven. Prior to that operation, all cans to be sprayed must be washed thoroughly to remove all traces of lubricant used to allow forming of the original plate into a container shape. This applies to cans made by draw/redraw methods or by drawing and ironing techniques (see for example U.S. Pat. No. RE 27,662). The problem in both cases with the cleaning operation is that the lubricant has been forced into all available pores, aberrations, interstices, etc. in the metal surface due to the high pressure applied by the tooling to the metal in order to form it, in the presence of lubricant. The washing must be done with the aid of chemical cleaners, the cans must be rinsed with deionized water to remove all traces of the cleaner, and the cans must then be oven dried in order to eliminate spotting from residual rinse water. The cost of this operation depends to some extent on the size of the can, the number of cans produced per year, and other factors (such as neutralization needed in order to send the cleaning solution into a sanitary sewer system, quality of the water available for the original wash cycle etc.). Drawn containers of precoated metals are commercial but it is recognized that a post sprayed container can have superior product resistance for certain hard to hold foods.

The three-piece container has a body rolled into a cylinder which comprises a side seam and two double seamed ends. Such containers are normally precoated, do not require the use of lubricant during forming and, thus, are easier to process. In contrast, the need to remove the heavy lubrication on two-piece cans after deep drawing requires can washing and drying energy, equipment and materials. Each requirement is costly in terms of capital investment, plant space and energy consumption. In addition, the drying process is environmentally deleterious since vapors are driven off, fuel is consumed generating heat and products of combustion.

It is an object of this invention to eliminate the need to wash lubricants for deep drawing.

A further object is to provide a lubricant which will also effectively permit metal strip to be deeply drawn without surface damage to the metal from which the container is formed.

It is a further object to provide a lubricant which can be successfully overcoated during a post spraying operation and which will permit the post coating to form a strong bond with the container.

SUMMARY AND DETAILED DESCRIPTION OF THE INVENTION

It has been found that the desired objects of the invention and the problems of the prior techniques can be successfully overcome by a lubricant that permits direct over-spray of the drawn can interior after forming but without removal of the remaining lubricant thereby saving expense and energy normally associated with the handling, the cleaning, the washing and/or the drying processes.

The lubricant is a combination of General Electric's silicone resin SR82 mixed in a compatible aromatic hydrocarbon solvent, such as a toluene solution, to a concentration of 60% solids, and lanolin carried in a compatible aliphatic hydrocarbon solvent such as heptane, available commercially as Skelly C. The concentration of the combination contains 4% by volume of the lubricant materials or, expressed in another way approximately 3.68% of solids. A combination where one part by volume SR82 and toluene (60% solids) are mixed with four parts by volume of 100% liquid lanolin, and the combination then dissolved in toluene and heptane is preferred. The aromatic solvent toluene is used to prevent precipitation of the SR82 silicone resin and the aliphatic heptane fraction gives good solvency to the lanolin. Tests of different concentrations of lubricant solids applied to bare tinplate stock by roller application and felt-wipe have produced good results in that post spraying without can washing produced an acceptable internal coverage with good adherence.

Different coating systems sprayed over the preferred lubricant have been tried including solvent based coatings such as an epoxy-phenolic or vinyl-organosol wherein the solvents are oxygenated, aromatic, and aliphatic hydrocarbons. Water based materials which are preferred for environmental reasons have also been tried with good results.

More particularly, the post sprayed container can be quickly tested by filling it with an electrolyte and checking the continuity or lack thereof between the outside of the container body and an electrode in the center of the electrolyte. Such a procedure is called quick testing and is common in the can manufacturing industry.

In order to perform a quick test a specified piece of equipment is required. Most particularly, a Model 1071 WACO Enamel Rater with a 0 to 1 milliamp attachment is used. The apparatus has an electrode which is adapted to move vertically in and out along the axis of a can positioned beneath it. The electrode is positioned about 1" from the bottom of the can. The can is held in position by a vise-like device which clamps it about the bottom holding it so that the open end of the can forces up toward the electrode. The can is filled with 2% solution of sodium sulfate and allowed to soak for at least 30 seconds before the electrode is dropped into the can. The solution temperature should be maintained between 72° to 78° F., and the can should be filled so that when the electrode is lowered into the test position the solution will reach approximately ⅛" below the top flange radius. Care should be taken to avoid wetting the flange since that will result in a false high reading. The milliamp meter of the tester is connected to the vise-like device which holds the bottom of the can. The electrode is connected to another lead of the milliamp meter. A zeroing of the instrument is required and the operator adjusts the milliamp to read "T" on the scale. Shortly after zeroing the meter a warning light comes on and the reading should be taken immediately. When this procedure was applied to the cans postcoated over the combined lubricant and silicone resin, readings in the range of 0 to 3 milliamps were obtained and such data is indicative of properly coated cans. The cans were subsequently packed with various food and processed at temperatures of 240°–270° F. Taste tests and analytical studies have verified the efficacy of the coatings as applied over the combination.

Although post sprayed coatings generally yield quick test readings in the range of 1 to 3 milliamps, there can be an occasional small area of metal exposure resulting from a piece of dirt on the surface as it is being sprayed, or dirt from particles in the air during oven curing, and those areas are sometimes attacked by the product packed in the can. By choice of the proper metal substrate (electrolytic tin plate of various tin weights, or tin free steel—CT) various foods can be packed and properly held. Possible metal exposure is the reason for different metal substrates being used for different products, even though the post spray coating is the same. In the event of exposure, tin coatings on the substrate will reduce the amount of attack by the more active foods. For example, coated TFS-CT is adequate for beef stew, but probably not for green beans, which may require coated #25 or #50 ETP, and certainly not for blueberries or red sour pitted cherries, which normally require coated #75 or #100 ETP pounds per base box which is the industry convention for amount of electrolytically deposited tin on steel. Similarly, peanut oil has also been mixed with General Electric's SR82, and has upon checking with quick test, after post spraying, performed successfully.

EXPLANATION OF THE INVENTION

Certain silicone resins such as General Electric's SR82 are known for their ability to modify coatings and thereby enhance their bond with a metal substrate to which they are applied. More particularly, the addition of silicone resin such as General Electric's SR82 to lanolin acts to permit subsequently applied coatings (after forming) to cover the surface of the metal substrate completely. That is to say that, without the addition of silicone resin to the lanolin it would prevent complete coverage of portions of metal substrates by coatings applied after forming leaving eye holes, discontinuities in the coverage or even tendencies for the coating to bead up. The affect is much like water on freshly waxed surfaces. The addition of silicone resin permits a wetting action and alters the surface tension of the lanolin sufficiently to allow the coatings as applied to spread evenly and completely over the lubricated (lanolin and silicone resin combination) metal substrate and to form a good bond across the entire surface. The proposed combination of silicone resin and lanolin when preapplied to coils or panels of tin free steel plate, electrolytic tinplate or other materials for deep drawing containers or cup-like objects which are intended to be post sprayed or post decorated performs successfully because of the bonding and good adherence of the wettable combination to the lubricated metal surface. If lubrication is the only requirement, a complete coverage of the metal surface is not necessary since the drawing tools tend to spread whatever lubricant is available and a coating of lubricant builds on the tools to the extent that sufficient lubrication is available for the forming process even on material which is slightly under lubricated. The wetting is necessary to provide sufficient adherence to the metallic substrate.

The lubricant and silicone resin combination is applied as a solvent solution such that the combination remains as a film on the surface of the metal after the solvent has evaporated. Consequently, the lubricant may be applied to the plate to be drawn several days prior to use (so long as the surface so coated is protected from settling dust and impurities). The evaporation time for the solvents at normal room temperature when applied in the concentrations preferred is approximately 20 seconds, if a roller type applicator is used in combination with a felt wiper to remove the excess.

EXAMPLE 1

A 4% mixture may be made by dissolving 24 mililiters of SR82 as received from General Electric (a toluene solution of a specific pure silcone resin with 60% solids) in sufficient toluene to make 1550 ml total solution. To this was added a solution of 96 ml of liquid lanolin (Ritalan 100% pure, from R.I.T.A. Chemical Company) in sufficient Skelly "C" (Heptane) to make 1450 ml of total solution. The combination gives approximately 3000 ml containing 4% by volume or 120 ml of the lubricant materials such that the solids concentration would be about 3.68%. The combination was applied to coil stock feed to the press and in the actual operation sufficient time to permit evaporation of the solvents was available when the distance between the felt wiper and the centerline of the press tools was 17 feet. The stock 50/100 ETP as received from the steel mill was fed at a rate of 8½" per second and the combined lubricant and resin were applied at a rate of 15 to 25 mgs per square foot. The best lubricant in solvent concentration was found to be approximately 4% by volume or more particularly 4.5%±0.5%. This concentration was necessary for lubricating in a continuous draw/redraw process, with a total of three drawing stations. If it is merely a drawing operation with only one step forming the lubricant concentration can be lowered to 2% by volume, and applied at 8 to 12 mgs per square foot. Ten thousand cans were deeply drawn in three stations and post coated with an epoxy phenolic solvent based coating. The coating was applied by spray at a rate sufficient to give a weight of about 25 mg per 4 square inches and then baked at 400° F. for seven minutes in a continuous oven. Quick test results on randomly sampled containers gave readings of 0–3 ma.

EXAMPLE 2

The combination of silicone resin and lanolin was the same as in Example 1, however, the metal stock was strip fed, TFS-CT precoated on both sides with an epoxy-vinyl coating at a level of 13 mg per 4 square inches. Felt wipers were saturated with the combination and the surfaces wiped across the wet wipers to coat the strips. Five thousand containers were drawn and redrawn in a three step operation and subsequently post coated as set forth in Example 1. Quick test results were extremely good in that readings were between 0–1 ma.

EXAMPLE 3

One part of petrolatum by volume was mixed with 1.66 parts by volume of SR82 as received from General Electric. The mixture was thinned with about 50 parts of toluene to give a 4% by weight solution. The combination was applied by the procedure of Example 2 to the metal materials of Examples 1 and 2 and containers were drawn and redrawn in three operations as before. The post coating in this Example was an epoxy water base material applied by spraying at a rate of about 20 mg per 4 square inches and cured in continuous operation at 380° F. for 2 minutes. Quick test results gave readings of 5 to 25 ma.

EXAMPLE 4

The combination of silicone resin and lanolin of Examples 1 and 2 applied as in Example 2 on the material of Example 2 and post coated with the water base epoxy of Example 3. Quick test results gave readings of 1–4 ma for material Example 1 and 0 ma for the other.

EXAMPLE 5

This was identical to Example 1 except that peanut oil was used in place of lanolin as the lubricant in the combination. The quick test results gave readings of 5 to 9 ma which was not as good but for some foods would be acceptable.

A typical container as formed by the draw/redraw process using the lubricant combination of this invention is a 303×406 two-piece steel can. The inside diameter of the triple drawn finished container is 3.060", the height is 4.375", and the bottom and sidewall thickness are approximately 0.0083", when the feed stock was 75 #T-4 plate; either TFS-CT tin free steel or electrolytic tinplate having various tin weights deposited on both sides of the plate will perform acceptably.

The combination of lanolin and General Electric's SR82 can be applied as described previously from a solvent solution using a roller applicator and suitable doctor blades or felt wipers to remove the excess so as to yield about 20 mgs per square foot of the combination on each side of the plate to be treated, after the solvents are removed. The combination can also be applied from a solvent dissolved system where the combination is at concentrations as high as about 60% (in toluene as the solvent) by spraying onto the plate to be lubricated. A typical installation for applying lubricants to strips of plate in this manner employs a continuous conveyor belt which brings the strips past an air atomizing nozzle which is spraying the combination downward onto the plate. Through adjustments to the nozzle flow rate, and by varying the speed of the belt, a coverage of about 20 mgs per square foot is readily attained. Similarly, such a spray or atomizing system could be used to lubricate a precoated TFS-CT coil on a coil coating line, or to lubricate a coil of uncoated electrolytic tinplate which is to be converted to containers suitable for post coating without further washing or cleaning treatment.

While the preceeding has dealt with various examples and various materials, the invention in its broadest aspect is considered to include any type of silicone resin with the appropriate drawing lubricant which permits a subsequently applied coating to spread evenly over the remaining combination after a deep drawing operation and results in a good bond to the metal substrate after curing of the coating. For specific applications which require more severe draws and/or thinner post coatings, the amounts of the various constituents in the combination can be varied in order to maintain low costs with a lubricant which will perform successfully. In addition, post coating of all ranges of tin coverage on steel will work successfully with this type of lubricant combination. Lightly precoated tin free steels (TFS-Ct) will also succeed in processing into post coatable containers using this combination.

What is claimed is:

1. A method of deep drawing thin metal stock into containers and post-coating said containers including the steps of:

(a) providing a lubricant composition that consists essentially of a combination of (1) air drying type hydroxylated alkyl silicone resin mixed in an aromatic hydrocarbon solvent and (2) peanut oil or lanolin mixed in an aliphatic hydrocarbon solvent;

(b) applying said composition to an uncoated or precoated metal substrate in an amount sufficient to form a uniform dispersion of such composition across the substrate surfaces;

(c) permitting said composition to dry to form a lubricant film over the surfaces of said metal substrate;

(d) progressively forming by deep drawing the lubricant film covered substrate into a deeply drawn container having a depth which is greater than its width;

(e) applying a post-coating synthetic resin composition to said deeply drawn container without removing residual lubricant film, and (f) subjecting said post-coated deeply drawn container to elevated temperature to form a bonded film on the surfaces of said container.

2. A method as claimed in claim 1 wherein said silicone resin is SR-82.

3. A method as claimed in claim 2 wherein said aromatic hydrocarbon is toluene.

4. A method as claimed in claim 3 wherein said aliphatic hydrocarbon is heptane.

5. A method as claimed in claim 4 wherein said composition is a combination of (1) one part silicone resin SR-82 mixed in toluene with (2) four parts lanolin mixed in heptane, admixed in a mixture of heptane and toluene.

6. A method as claimed in claim 1 wherein said metal substrate is uncoated prior to step (b) and said composition is a combination of (1) silicone resin SR-82 mixed in toluene to a concentration of 60% solids and (2) lanolin mixed in heptane and wherein the combination is dissolved in a mixture of toluene and heptane.

7. The method of claim 1 wherein the aliphatic and aromatic hydrocarbon solvents are present in approximately equal porportions in the composition.

8. The method of claim 1 wherein said post-coating composition comprises an epoxy phenolic solvent based coating.

9. A method of deep drawing metal stock into containers and post-coating the container comprising the steps of:

(a) providing a lubricant composition that consists essentially of (1) air drying type hydroxylated alkyl silicone resin mixed in an aromatic hydrocarbon solvent and (2) lanolin mixed in an aliphatic hydrocarbon solvent;

(b) applying said combination to an uncoated steel substrate in an amount sufficient to form a uniform dispersion of said lubricant composition on said steel substrate surfaces;

(c) drying said lubricated steel to form a film of said lubricant composition on the surfaces of said steel substrate;

(d) progressively forming by deep drawing the lubricant film covered substrate into a deeply drawn container having a depth which is greater than its width;

(e) applying a post-coating composition comprising an epoxy-phenolic or vinyl organosol resin to said deeply drawn container without removing residual lubricant film; and (f) subjecting the post-coated deeply drawn container to elevated temperature sufficient to from a bonded film on the metal surfaces of said container.

10. The method of claim 9 wherein said lubricant composition consists of (1) silicone resin SR-82 mixed in toluene and (2) lanolin mixed in heptane and wherein said components (1) and (2) are further admixed in a mixture of toluene and heptane.

11. The method of claim 10 wherein said steel substrate is electrolytic tinplate.

12. A method of deep drawing electrolytic tinplate or TFS-CT steel into containers and post-coating the containers comprising the steps of:

(a) providing a lubricant composition consisting essentially of the combination of (1) SR-82 air-drying type hydroxylated alkyl silicone resin mixed in toluene and (2) lanolin mixed in heptane, the combination being derived from (i) about one part by volume SR-82 and toluene mixed with (ii) about four parts by volume of liquid lanolin mixed with heptane, the combination being combined in a mixture of toluene and heptane;

(b) applying said composition to uncoated electrolytic tinplate or precoated TFS-CT steel substrate to form a uniform dispersion of said lubricant composition on said tinplate or TSF-CT steel substrate surfaces;

(c) air drying said lubricated steel to form a film of said lubricant composition on the surfaces of said tinplate or TFS-CT steel substrate;

(d) progressively forming by deep drawing the lubricant film covered substrate into a deeply drawn container having a depth which is greater than its width;

(e) applying a post-coating comprising an epoxy-phenolic or vinyl organosol resin to said deeply drawn container without removing residual lubricant film; and (f) subjecting the post-coated deeply drawn container to elevated temperature sufficient to form a bonded film of said epoxy-phenolic or vinyl-organosol resin on the surfaces of said container.

13. A method as claimed in claim 12 wherein said lubricant composition is derived by admixing (1) SR-82 silicone resin mixed in toluene to a concentration of about 60% solids with (2) liquid lanolin in heptane with (3) a mixture of heptane and toluene to give a final solution comprising approximately 3.68% to 4.5% solids.

14. A method as claimed in claim 13 wherein said lubricant composition is applied at a rate of 15 to 25 mgs. per square foot of tinplate or precoated TFS-CT steel substrate.

15. A method of deep drawing electrolytic tinplate or TFS-CT steel into containers and post-coating the containers comprising the steps of:

(a) providing a lubricant composition consisting essentially of the combination of (1) SR-82 air-drying type hydroxylated alkyl silicone resin mixed in toluene and (2) lanolin mixed in heptane, the combination being derived from (i) about one part by volume SR-82 and toluene mixed with (ii) about four parts by volume of liquid lanolin mixed with heptane, the combination being combined in a mixture of toluene and heptane;

(b) applying said composition to TFS-CT precoated with an epoxy-vinyl coating composition to form a uniform dispersion of said lubricant composition on said precoated, TFS-CT steel substrate surfaces;

(c) air drying said lubricated steel to form a film of said lubricant composition on the surfaces of said precoated tinplate or TFS-CT steel substrate;

(d) progressively forming by deep drawing the lubricant film covered substrate into a deeply drawn container having a depth which is greater than its width;

(e) applying a post-coating comprising an epoxy-phenolic or vinyl organosol resin to said deply drawn container without removing residual lubricant film; and (f) subjecting the post-coated deeply drawn container to elevated temperature sufficient to form a bonded film of said epoxy-phenolic or vinyl-organosol resin on the surfaces of said container.

* * * * *